US008876102B2

(12) United States Patent
Todoriki et al.

(10) Patent No.: US 8,876,102 B2
(45) Date of Patent: Nov. 4, 2014

(54) PAPER SHEET TAKEOUT DEVICE WITH AIR SUPPLY PORT DIRECTED DIFFERENTLY THAN NEGATIVE PRESSURE CHAMBER OPENING

(75) Inventors: Toru Todoriki, Kanagawa-ken (JP); Yusuke Mitsuya, Kanagawa-ken (JP); Yoshihiko Naruoka, Kanagawa-ken (JP); Yukio Asari, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 543 days.

(21) Appl. No.: 12/792,046

(22) Filed: Jun. 2, 2010

(65) Prior Publication Data

US 2010/0308530 A1 Dec. 9, 2010

(30) Foreign Application Priority Data

Jun. 4, 2009 (JP) ..... 2009-135255

(51) Int. Cl.
*B65H 3/12* (2006.01)
*B65H 1/02* (2006.01)

(52) U.S. Cl.
CPC ..... *B65H 3/124* (2013.01); *B65H 3/128* (2013.01); *B65H 1/025* (2013.01); *B65H 2406/412* (2013.01); *B65H 2701/1912* (2013.01); *B65H 2701/1916* (2013.01)
USPC ..... 271/94

(58) Field of Classification Search
USPC ..... 271/94
See application file for complete search history.

(56) References Cited

U.S. PATENT DOCUMENTS

| | | | | |
|---|---|---|---|---|
| 3,312,464 | A | 4/1967 | Rehn | |
| 6,918,581 | B2 * | 7/2005 | Horiuchi | 271/96 |
| 2007/0296136 | A1 | 12/2007 | Fukusaka et al. | |
| 2009/0057986 | A1 | 3/2009 | Yaginuma | |
| 2010/0207315 | A1 * | 8/2010 | Todoriki et al. | 271/94 |

FOREIGN PATENT DOCUMENTS

| | | | |
|---|---|---|---|
| CN | 1496944 | A | 5/2004 |
| CN | 101444939 | A | 6/2009 |
| EP | 0 990 609 | A2 | 4/2000 |
| JP | 57189941 | A | 11/1982 |
| JP | 2300033 | A | 12/1990 |
| JP | 05-338849 | | 12/1993 |

(Continued)

OTHER PUBLICATIONS

Japanese Office Action dated Apr. 23, 2013.
European Search Report dated Nov. 6, 2012.

*Primary Examiner* — Gerald McClain
(74) *Attorney, Agent, or Firm* — Oblon, Spivak, McClelland, Maier & Neustadt, L.L.P.

(57) ABSTRACT

In one embodiment, a supply mechanism is provided. The supply mechanism supplies accumulated paper sheets to a takeout position sequentially. A takeout belt having adsorption hole runs along a surface of the takeout position. An opening of a negative pressure chamber is arranged so as to face the takeout belt. A suction unit sucks air existing at the takeout position via the opening and the adsorption holes. The suction unit causes a negative pressure to act on each of the paper sheets so that each is adsorbed onto an adsorption surface of the takeout belt. The suction unit has an air supply port to supply air into the negative pressure chamber. The air supply port is arranged so that the air supplied via the air supply port is directed to a position and in a direction different from those of the opening.

10 Claims, 7 Drawing Sheets

(56) References Cited

FOREIGN PATENT DOCUMENTS

| | | | |
|---|---|---|---|
| JP | 05338849 A | * | 12/1993 |
| JP | 10120212 A | | 5/1998 |
| JP | 11-072169 | | 3/1999 |
| JP | 2000-109229 | | 4/2000 |
| JP | 2002145470 A | | 5/2002 |
| JP | 2008-273666 | | 11/2008 |

* cited by examiner

PAPER SHEET TAKEOUT DEVICE WITH AIR SUPPLY PORT DIRECTED DIFFERENTLY THAN NEGATIVE PRESSURE CHAMBER OPENING

CROSS-REFERENCE TO RELATED APPLICATION(S)

This application is based upon and claims the benefit of priority from the prior Japanese Patent Application No. 2009-135255, filed on Jun. 4, 2009, the entire contents of which are incorporated herein by reference.

FIELD

Embodiments described herein relate generally to a paper sheet takeout device to move accumulated paper sheets in an accumulation direction to a takeout position sequentially, to adsorb the same and to take out the same to a conveyance path.

BACKGROUND

A paper sheet takeout device is used in a processing device for processing various paper sheets such as mail articles, bank notes, or ID cards.

Japanese Patent Application publication No. 2000-109229 discloses a paper sheet takeout device which is provided with an adsorption belt, a negative pressure chamber and a blower. The adsorption belt runs along paper sheets at a takeout position. The negative pressure chamber is disposed on a back surface side of the adsorption belt. The blower evacuates the negative pressure chamber. The adsorption belt has a plurality of holes formed in a length direction. The negative pressure chamber has an opening facing the back surface of the adsorption belt. An electromagnetic valve is disposed halfway of an air hose connecting the negative pressure chamber to the blower.

In order to take out the paper sheets, the negative pressure chamber is evacuated by the blower so that air existing at the takeout position is sucked via the opening of the negative pressure chamber and via the holes of the adsorption belt. The evacuation causes a negative pressure to act on the paper sheets moved to the takeout position and to adsorb the paper sheets to the adsorption belt. In this state, the adsorption belt is run, and the adsorbed paper sheets are taken out to a conveyance path.

Further, the taken out paper sheets are delivered to a conveyance section downstream of the conveyance path. When the delivery is completed, the electromagnetic valve is closed to return a pressure of the negative pressure chamber to the atmospheric pressure so that an operation of adsorbing the paper sheets is finished.

DETAILED DESCRIPTION

Figure 1:
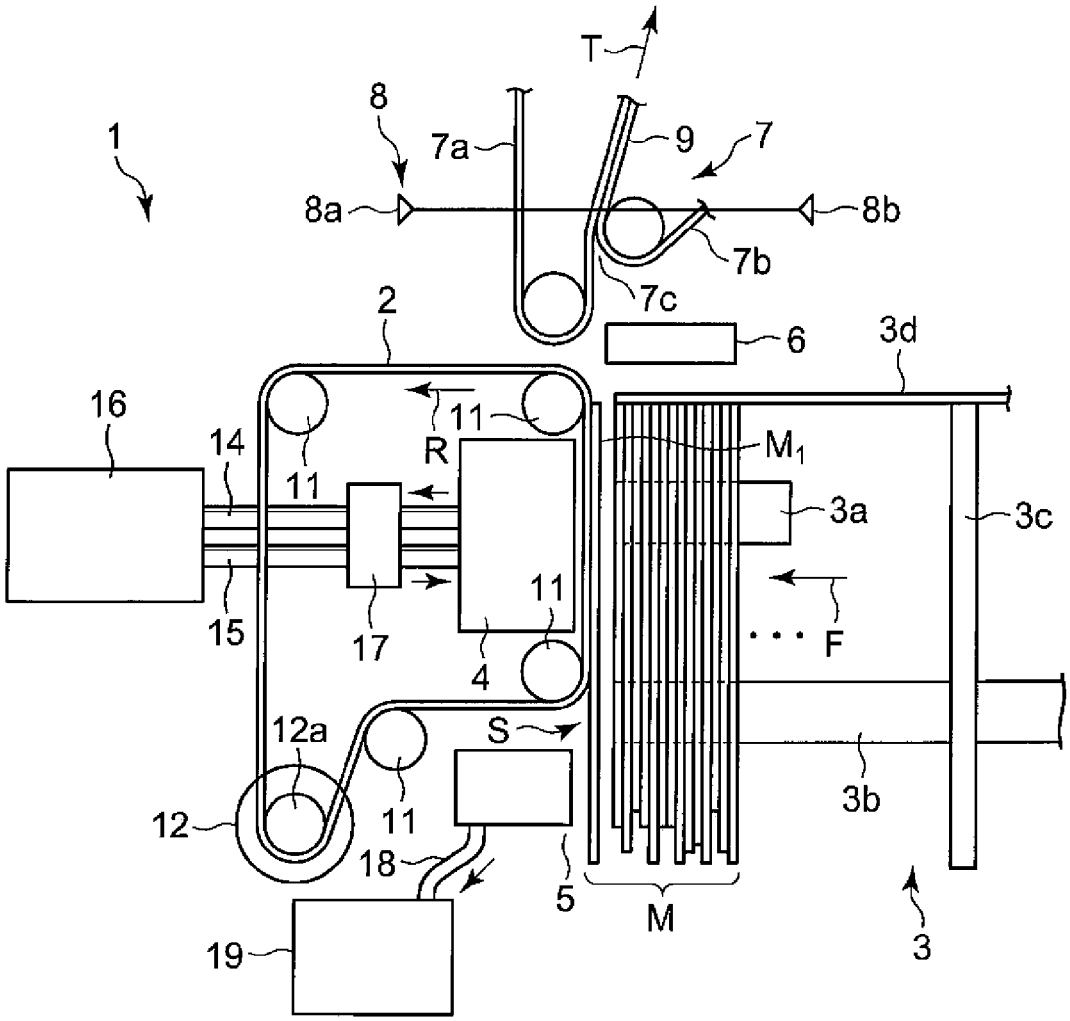
FIG. 1 is a plan view of a paper sheet takeout device according to a first embodiment.

According to one embodiment, a paper sheet takeout device is provided. The paper sheet takeout device has a supply mechanism, a takeout belt, a negative pressure chamber and a suction unit having an air supply port.

The supply mechanism moves a plurality of accumulated paper sheets in an accumulation direction to supply the accumulated paper sheets to a takeout position sequentially from one of the paper sheets positioned at an end of an accumulation direction. The takeout belt has a plurality of adsorption holes. The takeout belt runs along a surface of the takeout position. The negative pressure chamber has an opening. The opening is arranged so as to face a surface of the takeout belt opposite to an adsorption surface of the takeout belt facing the takeout position.

The suction unit sucks air existing at the takeout position via the opening and the adsorption holes by evacuating the negative pressure chamber. The suction unit adsorbs each of the paper sheets sequentially supplied to the takeout position onto the adsorption surface of the takeout belt by causing a negative pressure to act on each of the paper sheets. The air supply port supplies air into the negative pressure chamber and returns the negative pressure to the atmospheric pressure. The air supply port is arranged so that the air supplied via the air supply port is directed to a position and in a direction different from those of the opening.

According to another embodiment, a paper sheet takeout device is provided. The paper sheet takeout device has a supply mechanism, a takeout belt, a negative pressure chamber and a suction unit having an air suction port and an air supply port.

The supply mechanism moves a plurality of accumulated paper sheets in an accumulation direction to supply the accumulated paper sheets to a takeout position sequentially from one of the paper sheets positioned at an end of an accumulation direction. The takeout belt has a plurality of adsorption holes. The takeout belt runs along a surface of the takeout position. The negative pressure chamber has an opening. The opening is arranged so as to face a surface of the takeout belt opposite to an adsorption surface of the takeout belt facing the takeout position.

The suction unit sucks air existing at the takeout position via the opening and the adsorption holes by evacuating the negative pressure chamber through the air suction port. The suction unit adsorbs each of the paper sheets sequentially supplied to the takeout position onto the adsorption surface of the takeout belt by causing a negative pressure to act on each of the paper sheets. The air suction port is formed at a position facing the opening of the negative pressure chamber so as to suck air from the negative pressure chamber. The air supply port supplies air into the negative pressure chamber and returns the negative pressure to the atmospheric pressure. The air supply port is arranged so that the air supplied via the air supply port is directed to a position and in a direction different from those of the opening.

According to further another embodiment, a paper sheet takeout device is provided. The paper sheet takeout device has a supply mechanism, a takeout belt, a negative pressure chamber and a suction unit having an air suction port.

The supply mechanism moves a plurality of accumulated paper sheets in an accumulation direction to supply the accumulated paper sheets to a takeout position sequentially from one of the paper sheets positioned at an end of an accumulation direction. The takeout belt has a plurality of adsorption holes. The takeout belt runs along a surface of the takeout position. The negative pressure chamber has an opening. The opening is arranged so as to face a surface of the takeout belt opposite to an adsorption surface of the takeout belt facing the takeout position.

The suction unit sucks air existing at the takeout position via the opening and the adsorption holes by evacuating the negative pressure chamber through the air suction port. The suction unit adsorbs each of the paper sheets sequentially supplied to the takeout position onto the adsorption surface of the takeout belt by causing a negative pressure to act on each of the paper sheets. The air suction port is formed at a position facing the opening of the negative pressure chamber.

Hereinafter, further embodiments will be described with reference to the drawings. In the drawings, the same reference numerals represent the same or similar portions, respectively.

A paper sheet takeout device (hereinafter referred to simply as "takeout device") according to a first embodiment will be described with reference to FIGS. 1 to 3.

FIG. 1 shows a plan view of a takeout device according to the first embodiment which is seen from above. FIG. 2 shows a partially enlarged view of a takeout belt incorporated in the takeout device. FIG. 3 shows a block diagram of a control system to control an operation of the takeout device.

Figure 3:
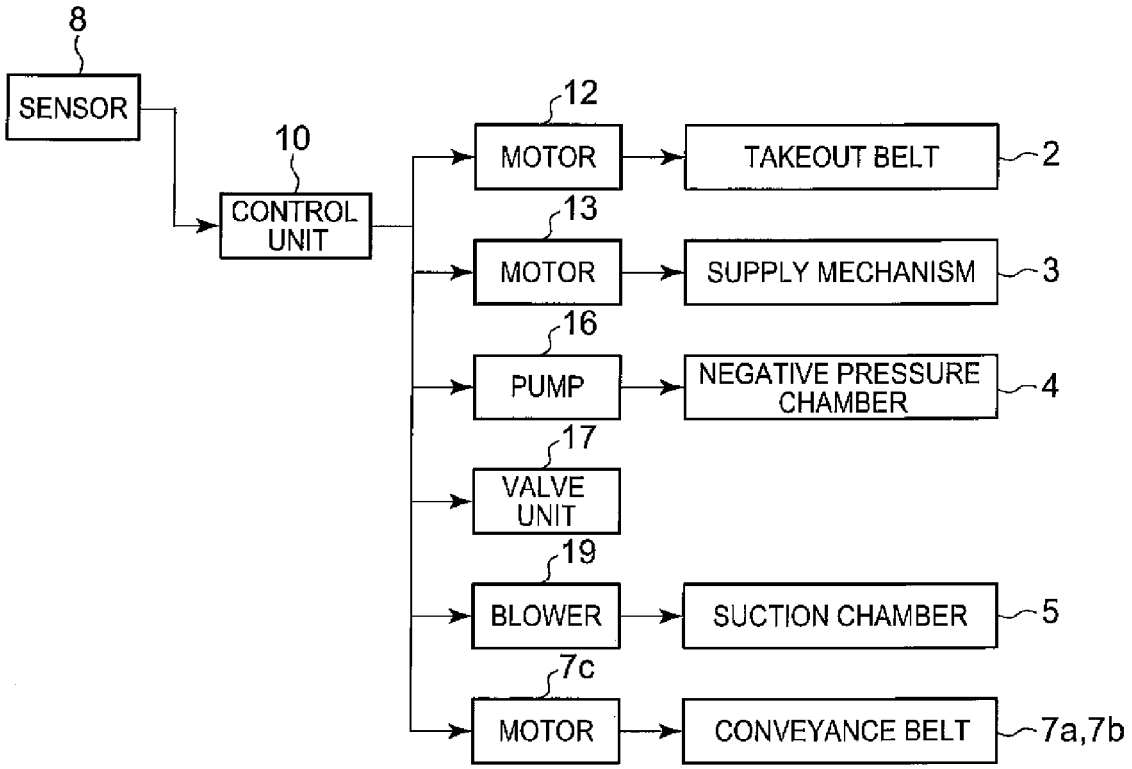
FIG. 3 is a block diagram showing a control system to control an operation of the takeout device of FIG. 1.

As shown in FIG. 1, the takeout device 1 includes a takeout belt 2, a supply mechanism 3, a rectangular parallelepiped negative pressure chamber 4, a suction chamber 5, a separation block 6, a conveyance mechanism 7, a sensor 8 and a control section 10 shown in FIG. 3.

The takeout device 1 can be applied as a processing device for various paper sheets such as mail articles, bank notes or ID cards. Hereinafter, an example case will be described. The example case is that a plurality of mail articles M having different sizes are treated.

Figure 2:
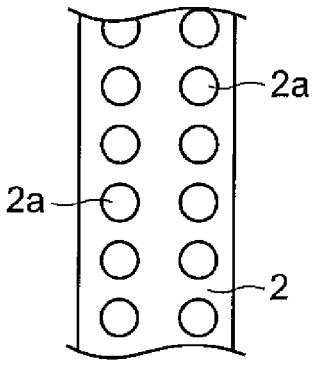
FIG. 2 is an enlarged view partially showing a takeout belt incorporated in the takeout device of FIG. 1.

As shown in FIG. 2, the takeout belt 2 is an endless belt having a plurality of adsorption holes 2*a*. The takeout belt 2 is wound around a plurality of pulleys 11 and is stretched. The adsorption holes 2*a* are formed throughout the entire length of the belt.

The takeout belt 2 is also trained around a pulley 12*a* attached to a rotating shaft of a motor 12 and runs endlessly along a takeout position S described below and in a direction denoted by an arrow R in FIG. 1.

Although the motor 12 rotates at a constant speed continuously in the embodiment, the motor 12 may rotate intermittently in conformity with intervals at which the mail articles M are taken out.

The adsorption holes 2*a* of the takeout belt 2 are moved by the rotation of the takeout belt 2 and sequentially pass through the takeout position S.

When the pressure in the negative pressure chamber 4 is negative, a mail article M1 moved to the takeout position S is adsorbed to the takeout belt 2. When the pressure in the negative pressure chamber 4 is returned to the atmospheric pressure, an absorption force to the mail article M1 is eliminated so that the mail article M1 is not taken out.

The mail articles M are thrown into the supply mechanism 3 in an accumulated state and in a standing manner. The supply mechanism 3 moves the mail articles M to one end side of a accumulation direction of the mail articles M, i.e., a direction denoted by arrow F in FIG. 1. The supply mechanism 3 further moves the mail articles M to the takeout position S sequentially from a mail article M1 locating at the one end of the accumulation direction. The supply mechanism 3 sequentially supplies the mail articles M to the takeout belt 2.

In the following description, a mail article supplied to the takeout position S and to be taken out next is referred to as "mail article M1".

The supply mechanism 3 includes two floor belts 3*a*, 3*b*, a backup plate 3*c* and a fixed side plate 3*d*. The mail articles M are placed on the floor belts 3*a*, 3*b* in a standing manner and in a state where the lower end sides of the mail articles M are in contact with the floor belts 3*a*, 3*b*. The floor belts 3*a*, 3*b* supply the lower end sides of the mail articles M in the direction denoted by the arrow F.

One end portion of the backup plate 3*c* is arranged so that the one end portion contacts the side plate 3*d*. The backup plate 3*c* is slidable and rotatable while being in contact with the side plate 3*d*. The backup plate 3*c* pushes the mail articles M in a direction of the takeout position S by a repulsion force of a spring (not shown). Lateral end sides of the mail articles M come into contact with the side plate 3*d* and are aligned with the side plate 3*d*.

The floor belts 3*a*, 3*b* are driven by a motor 13 shown in FIG. 3 so that the lower end sides of the mail articles M in contact with the floor belts 3*a*, 3*b* move in the direction of the arrow F shown in FIG. 1. The backup plate 3*c* is also moved in the direction of the arrow F with the movement of the floor belt 3*b*, comes into contact with a mail article at the other end of the accumulation direction, and pushes the mail article in the direction denoted by the arrow F. The supply mechanism 3 is driven by the motor 13 and is operated each time the mail article M1 at the takeout position S is taken out.

Figure 7:
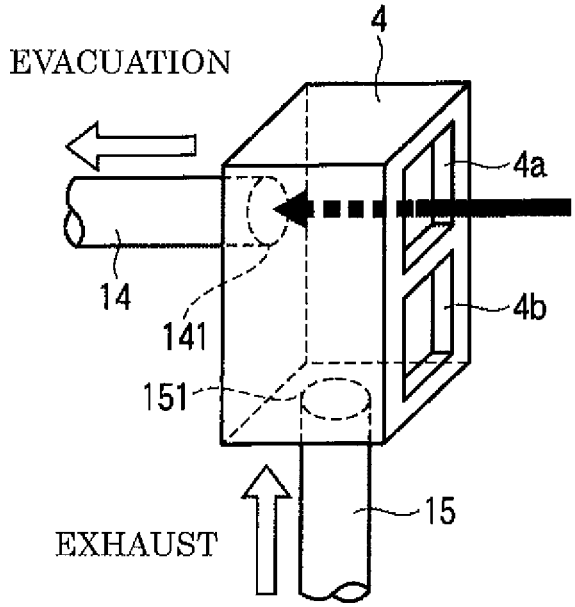
FIG. 7 is a perspective view showing a connection of an air suction tube and an air supply tube to a negative pressure chamber incorporated in the takeout device of FIG. 1.

The negative pressure chamber 4 is disposed at the takeout position S, i.e., at a position facing a back surface side (inside) of the takeout belt 2 which runs along a surface showing the takeout position S. In other words, the negative pressure chamber 4 is disposed at a position facing the takeout position S across the takeout belt 2. As shown in FIG. 7, the negative pressure chamber 4 has openings 4*a*, 4*b* which face the back surface of the takeout belt 2 shown in FIG. 1. The negative pressure chamber 4 is connected with a pump 16 of FIG. 1 as a suction unit, via an air suction tube 14 and an air supply tube 15 shown in FIGS. 1 and 7. As shown in FIG. 7, the air suction tube 14 and the air supply tube 15 are connected to an air suction port 141 and an air supply port 151 formed in the negative pressure chamber 4.

In FIG. 1, a valve unit 17 is attached halfway of the air suction tube 14 and the air supply tube 15 shown in FIG. 7. Optimum attachment positions and directions of the air suction tube 14 and the air supply tube 15 to the negative pressure chamber 4 will be described later in detail. For simplicity, the air suction tube 14 and the air supply tube 15 are simply arranged in parallel in FIG. 1.

The conveyance mechanism 7 of FIG. 1 is provided on a further downstream side of the separation block 6 along a takeout direction T of the mail articles M. The conveyance mechanism 7 has a conveyance path 9 formed on a downstream side of a line of the takeout position S. The conveyance mechanism 7 includes two endless conveyance belt 7*a*, 7*b* stretched so as to come into contact with each other across the conveyance path 9. The two conveyance belts 7*a*, 7*b* are run by the motor 7*c* of FIG. 3 in the direction of the arrow T at a constant speed. The mail articles M taken out onto the conveyance path 9 are held between the two conveyance belts 7*a*, 7*b* and conveyed to a further downstream side.

In FIG. 1, the negative pressure chamber 4 is evacuated by the pump 16 to adsorb the mail article M1 to the takeout belt 2. Further, the air suction tube 14 is opened by the valve unit 17, and the air existing at the takeout position is sucked via the openings 4*a*, 4*b* of the negative pressure chamber 4 of FIG. 7 and via the adsorption holes 2*a* of the takeout belt 2 of FIG. 2. The suction causes a negative pressure to be generated on a adsorption surface side of the takeout belt 2 facing the surface showing the takeout position S so that the mail article M1 positioned at the takeout position S is adsorbed to the adsorption surface of the takeout belt 2. The adsorbed mail article M1 is taken out in the direction of the arrow T by running of the takeout belt 2.

In order to stop adsorption of the mail article M1 by the takeout belt 2, the air suction tube 14 is closed and the air supply tube 15 is opened by operation of the valve unit 17. Thus, exhaust air is forcibly supplied into the negative pressure chamber 4 by the pump 16. Consequently, the pressure in the negative pressure chamber 4 is instantly returned to the atmospheric pressure, and the negative pressure generated on the adsorption surface side of the takeout belt 2 is eliminated. The elimination of the negative pressure is performed when the sensor 8 detects an leading end of the mail article M1 passing through the sensor 8 and determines that the mail article M1 is delivered to the conveyance mechanism 7.

The suction chamber 5 is disposed along the surface showing the takeout position S on an upstream side of the negative pressure chamber 4 and outside of the takeout belt 2. The suction chamber 5 has an opening (not shown) facing the mail article M1 across the surface of the takeout position S. A blower 19 is connected to the suction chamber 5 via an air suction tube 18. When the blower 19 is operated, air is sucked through the opening of the suction chamber 5 so that an air flow is generated to the takeout position S. The air flow functions to suck the mail article M1 to be adsorbed next to the takeout position S instantly.

The separation block 6 is disposed on a downstream side of the surface of the takeout position S along the takeout direction T.

The separation block 6 is designed such that an leading end of a second or subsequent mail article going in the takeout direction hits the separation block 6 in the case that such a mail article is drawn out together with the mail article M1 taken out from the takeout position S at the same time. Hereinafter, such a mail article is referred to as "overlying mail article Mw". As a result, The separation block 6*a* can prevent the problem that the overlying mail article Mw is taken out together with the mail article M1.

A conveyance speed of the mail articles M conveyed by the conveyance mechanism 7, namely a running speed of the two conveyance belts 7*a*, 7*b*, is set to a speed slightly faster than a takeout speed of the mail articles M taken out by the takeout belt 2. Accordingly, the mail articles M are drawn out immediately after leading ends of the mail articles M enter a nip 7*c* between the two conveyance belts 7*a*, 7*b*. In this case, an absorption force of the takeout belt 2 with respect to the mail articles M is also set smaller than a restriction force of the conveyance mechanism 7 against the mail articles M.

The sensor 8 includes a light emitting section 8*a* and a light receiving section 8*b* disposed on both sides of the sensor 8 across the conveyance path 9. The light emitting section 8*a* and the light receiving section 8*b* are positioned and fixed so that a light path between the sections passes in the vicinity of the nip 7*c* of the conveyance mechanism 7. The sensor 8 detects the leading ends of the mail articles M passing through the light path by detecting that the light path is blocked by the mail articles M taken out to the conveyance path 9. A control section 10 shown in FIG. 3 controls an operation of the valve unit 17 as will be described below based on an output of the light receiving section 8*b*, i.e., based on a signal showing "light" or "dark".

An operation to take out the mail articles M to the conveyance path 9 will be described below. The mail articles are taken out one by one by the takeout device 1 having the above structure As shown in FIG. 1, the mail articles M are thrown to the floor belts 3*a*, 3*b* in a standing manner, and moved in the direction of the arrow F as the floor belts 3*a*, 3*b* are driven by the motor 13 of FIG. 3. With the operation, the mail article M1 positioned at a leading end of an accumulation direction is supplied to the takeout position S. Each time a mail article positioned at the leading end is taken out from the takeout position S, the supply mechanism 3 moves the remaining mail articles in the direction of the arrow F.

The control section 10 of FIG. 3 runs the takeout belt 2 of FIG. 1 by the motor 12 of FIG. 3 to take out the mail article M1 positioned at the takeout position S to the conveyance path 9. At this time, the pressure in the negative pressure chamber 4 is reduced by evacuation performed by the pump 16 The reduced pressure causes a negative pressure to be generated on a front surface of the takeout belt 2. The mail article M1 positioned at the takeout position S is adsorbed to the takeout belt 2 by the negative pressure and is taken out.

An air flow generated at the takeout position S by the suction chamber 5 acts on the mail article M1 nearest to the takeout position S. As a result, the mail article M1 at a leading end of an accumulation direction is instantly drawn to the takeout position S by the suction chamber 5 and is adsorbed to the takeout belt 2.

The mail articles taken out from the takeout position S enter the nip 7*c* between the conveyance belts 7*a*, 7*b*. Leading ends of the mail articles positioned in the takeout direction are held by the nip 7*c*. The mail articles are conveyed further downstream. The taken-out mail articles M are detected to reach the nip 7*c* when an output of the sensor 8 changes from light to dark.

When the overlying mail article Mw is drawn out in a state that the mail article Mw overlies the mail article M1 taken out from the takeout position S, the mail article Mw is separated by the separation block 6.

When the mail article M1 taken out from the takeout position S is delivered to the conveyance mechanism 7, the control section 10 of FIG. 3 switches the valve unit 17 of FIG. 1 and supplies the exhaust air from the pump 16 into the negative pressure chamber 4. The exhaust air causes the pressure in the negative pressure chamber 4 to be returned to the atmospheric pressure instantly so that the negative pressure is eliminated on the back surface of the takeout belt 2, and the mail article M1 is released from being adsorbed.

Figure 4:
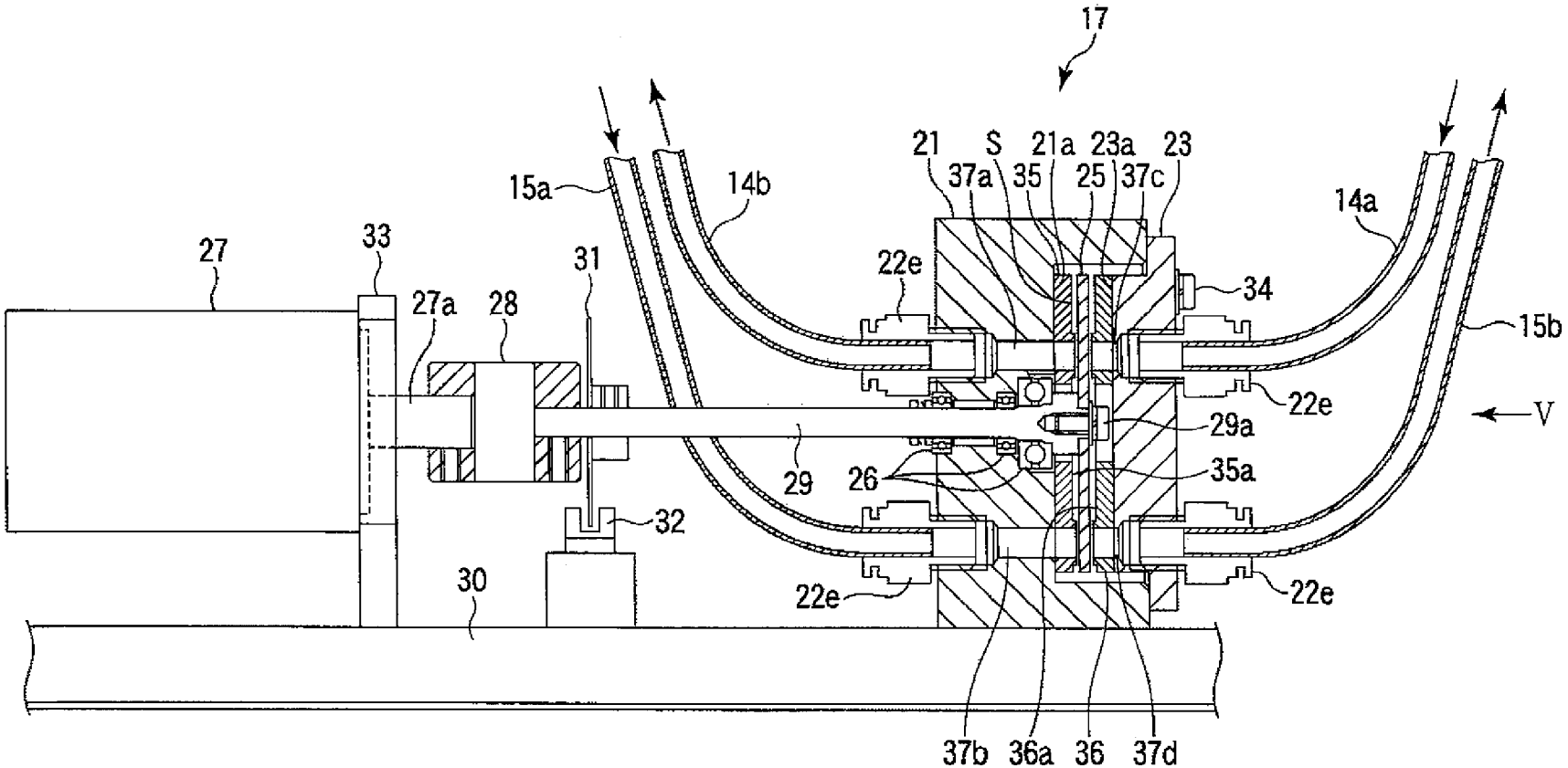
FIG. 4 is a sectional view showing a configuration of a valve unit incorporated in the takeout device of FIG. 1.
Figure 5:
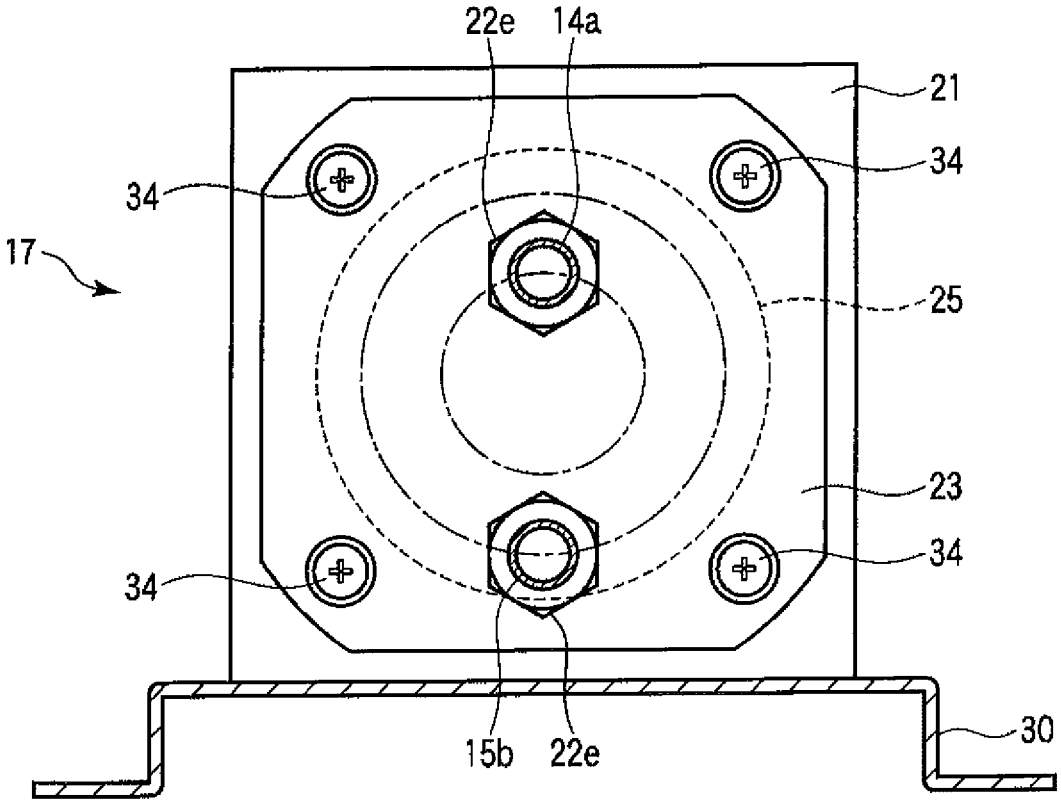
FIG. 5 is a schematic diagram of the valve unit of FIG. 4 which is seen from a direction denoted by an arrow V.
Figure 6:
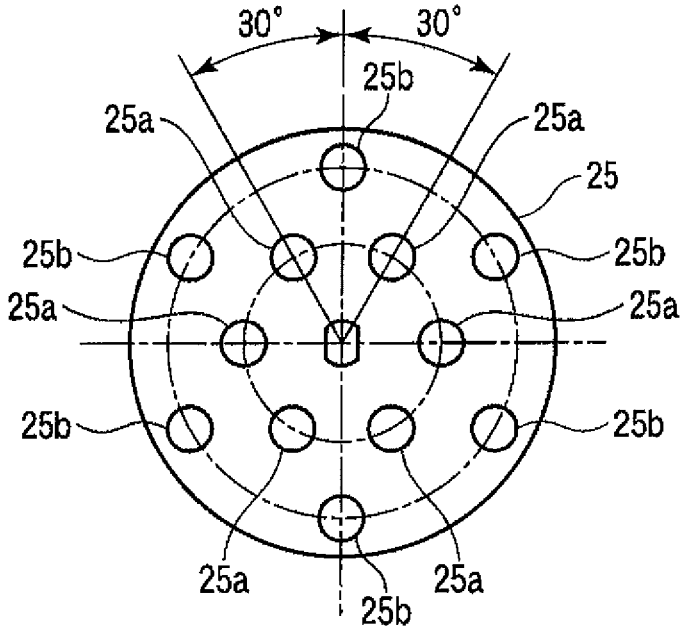
FIG. 6 is a schematic diagram showing a shield plate incorporated in the valve unit of FIG. 4.

FIG. 4 is a sectional view showing a configuration of the valve unit 17 described above. FIG. 5 is a side view of the valve unit 17 shown in FIG. 4 which is seen from a direction denoted by an arrow V. FIG. 6 shows a plan view of a shield plate 25 incorporated in the valve unit 17 of FIG. 4.

An upstream side air suction tube 14*a*, a downstream side air suction tube 14*b*, an upstream side air supply tube 15*a* and a downstream side air supply tube 15*b* are connected with the valve unit 17. The two air suction tubes 14*a*, 14*b* constitute the air suction tube 14 of FIG. 1, and the two air supply tubes 15*a*, 15*b* constitute the air supply tube 15 of FIG. 1. The valve unit 17 is disposed halfway of the air suction tube 14 and the air supply tube 15.

The valve unit 17 includes a substantially rectangular first block 21, a second block 23 facing the first block, the substantially circular shield plate 25 rotatably disposed in a space S, and a motor 27 to rotate the shield plate 25. The space S is formed between the first and second blocks 21, 23.

A drive shaft 29 of the shield plate 25 is coaxially connected to a rotating shaft 27*a* of the motor 27 via a coupling 28. The drive shaft 29 penetrates the first block 21 and extends. The drive shaft 29 is rotatably attached to the first block 21 via a plurality of bearings 26. The shield plate 25 is fixed to an end of the drive shaft 29 by a screw 29*a*.

A reference phase detection plate 31 is fixed to the drive shaft 29 of the shield plate 25. A detection sensor 32 is attached to a base 30. A plurality of cutouts (not shown) is formed at an outer peripheral end portion of the reference phase detection plate 31. The detection sensor 32 detects the cutouts of the reference phase detection plate 31 while being rotated. The first block 21 is fixed to the base 30. The motor 27 is attached to the base 30 via a bracket 33.

The cutouts of the reference phase detection plate 31 correspond to the positions of six connection holes 25*a* and six connection holes 25*b* provided in the shield plate 25 shown in FIG. 6. The cutouts can provide detection references to detect the respective positions. The control section 10 shown in FIG. 3 rotates and stops the motor 27 based on a result of the detection performed by the detection sensor of FIG. 4, in order to position the shield plate 25 at a desired phase.

The downstream side air suction tube 14*b* and the upstream side air supply tube 15*a* are connected with of the first block 21 from the side of the motor 27 via pipe couplings 22*e*, respectively. The upstream side air suction tubes 14*a* and the downstream side air supply tube 15*b* are connected with the second block 23 from a side opposite to the side of the motor 27 via pipe couplings 22*e*, respectively. More specifically, four tubes 14*a*, 14*b*, 15*a*, 15*b* are positioned so that the upstream side air suction tube 14*a* faces the downstream side air suction tube 14*b* in a substantially coaxial positional relation and that the upstream side air supply tube 15*a* faces the downstream side air supply tube 15*b* in a substantially coaxial positional relation. In this state, the second block 23 is fixed to the first block 21 by a plurality of bolts 34.

The first block 21 has a facing surface 21*a* facing the second block 23. The second block 23 has a facing surface 23*a* facing the first block 21. The facing surfaces 21*a*, 23*a* are formed in a circular shape slightly larger than the shield plate 25 and face in parallel with each other.

A shield member 35, which has approximately the same diameter as the shield plate 25, is bonded to the facing surface 21*a* of the first block 21. A shield member 36, which has approximately the same diameter as the shield plate 25, is also bonded to the facing surface 23*a* of the second block 23. The shield plate 25 is accommodated in the space S described above so that it is rotatably positioned between the shield members 35, 36. The shield plate 25 is rotated within the space S.

Elongated holes 37*a*, 37*b* are formed in the first block 21. The elongated hole 37*a* has one end connected to the downstream side air suction tube 14*b*. The elongated hole 37*b* has one end connected to the upstream side air supply tube 15*a*. The respective elongated holes 37*a*, 37*b* penetrate the shield member 35. The other ends of the elongated holes 37*a*, 37*b* are exposed to the space S.

Elongated holes 37*c*, 37*d* are formed in the second block 23. The elongated hole 37*c* has one end connected to the upstream side air suction tube 14*a*. The elongated hole 37*d* has one end connected to the downstream side air supply tube 15*b*. The respective elongated holes 37*c*, 37*d* penetrate the shield member 36. The other ends of the elongated holes 37*c*, 37*d* are exposed to the space S. The elongated hole 37*a* faces the elongated hole 37*c* substantially coaxially. The elongated hole 37*b* faces the elongated hole 37*d* substantially coaxially.

The elongated holes 37*a*, 37*b* are formed at inner positions nearer to the drive shaft 29 than the elongated holes 37*b* and the elongated hole 37*d*.

Although distances between facing surfaces 35*a*, 36*a* of the respective shield members 35, 36 are made slightly larger than a thickness of the shield plate 25, the facing surfaces 35*a*, 36*a* are formed nearer to each other in the portions where the other ends of the elongated holes 37*a*, 37*b*, 37*c*, 37*d* are exposed. Specifically, circumferential leading end portions of the other ends of the respective elongated holes in the respective shield members 35, 36 project annularly slightly toward the space S. Thus, an amount of air that leaks from the space S is made as small as possible in a state that the other ends of the elongated holes 37*a*, 37*b*, 37*c*, 37*d* are closed by the shield plate 25.

With such structure, while the amount of the air that leaks from the space S can be reduced, the shield plate 25 is not closely attached to the two shield members 35, 36 to allow rotation of the shield plate 25. A flow path of the valve unit 17 does not need to be hermetically closed to prevent a leakage of air. Operational problem does not arise even if air leaks a little.

As shown in FIG. 6, all the connection holes 25*a*, 25*b* of the shield plate 25 are formed in a circular shape having approximately the same diameters as inner diameters of the air suction tube 14 and the air supply tube 15. The shape of the connection holes 25*a*, 25*b* is not limited to the circular shape. The air suction tube 14 and the air supply tube 15 has a cylindrical shape typically, and thus the connection holes 25*a*, 25*b* preferably have the same sectional shape as the air suction tube 14 and the air supply tube 15 to make an air resistance as low as possible.

Further, in the shield plate 25 shown in FIG. 6, the connection holes 25*a* are arranged along a relatively small circumference near to a center of the shield plate 25 at equal intervals. The connection holes 25*b* are arranged along a relatively large circumference away from the center of the shield plate 25 at equal intervals. In the embodiment, the inner connection holes 25*a* are offset from the outer connection holes 25*b* by 30° so that they are not arranged on the same radius.

The six inner connection holes 25*a* are arranged at positions that overlap with the elongated hole 37*a* of the first block 21 and the elongated hole 37*c* of the second block 23, respectively, in order to connect the upstream side air suction tube 14*a* with the downstream side air suction tube 14*b* while the shield plate 25 rotates. The outer connection holes 25*b* are arranged at positions that overlap with the elongated hole 37*b* of the second block 21 and the elongated hole 37*d* of the second block 23, respectively, in order to connect the upstream side air supply tube 15*a* with the downstream side air supply tube 15*b* while the shield plate 25 rotates.

For example, when the motor 27 of FIG. 4 is driven by a control of the control section 10 of FIG. 3 and the shield plate 25 is rotated to and stopped at a position where one of the inner connection holes 25*a* overlaps with the inner elongated hole 37*a*, 37*c*, the elongated holes 37*b*, 37*d* are closed by the shield plate 25. In this state, the air suction tube 14 of FIG. 1 is opened and the air supply tube 15 is closed.

When the shield plate 25 shown in FIG. 4 and FIG. 6 is rotated 30° from the state that the air suction tube 14 is opened and is then stopped at a position where one of the outer connection holes 25*b* overlaps with the outer elongated holes 37*b*, 37*d*, the inner elongated holes 37*a*, 37*c* are closed by the shield plate 25. In this state, the air suction tube 14 of FIG. 1 is closed and the air supply tube 15 is opened.

The open/close states described above occur each time the shield plate 25 is rotated 30° . The air suction tube 14 can be opened six times while the shield plate 25 rotates once. The air supply tube 15 can be opened six times while the shield plate 25 rotates once. In other words, the valve unit 17 can open and close the air suction tube 14 and the air supply tube 15 alternately and repeatedly by rotating the shield plate 25 as much as 30° intermittently.

A large amount of air can be simultaneously sucked from the negative pressure chamber 4 of FIG. 1 and a large amount of air can be simultaneously supplied to the negative pressure chamber 4, by using the valve unit 17 having the above described structure. As a result, adsorption and release of the mail articles M can be instantly switched at a desired timing. The valve unit 17 can switch suction and supply of air only by rotating the motor 27 as much as 30° . The valve unit 17 itself has a high response speed. Accordingly, the takeout device 1 can continuously take out the mail articles M to the conveyance path 9 at a high speed.

Figure 8:
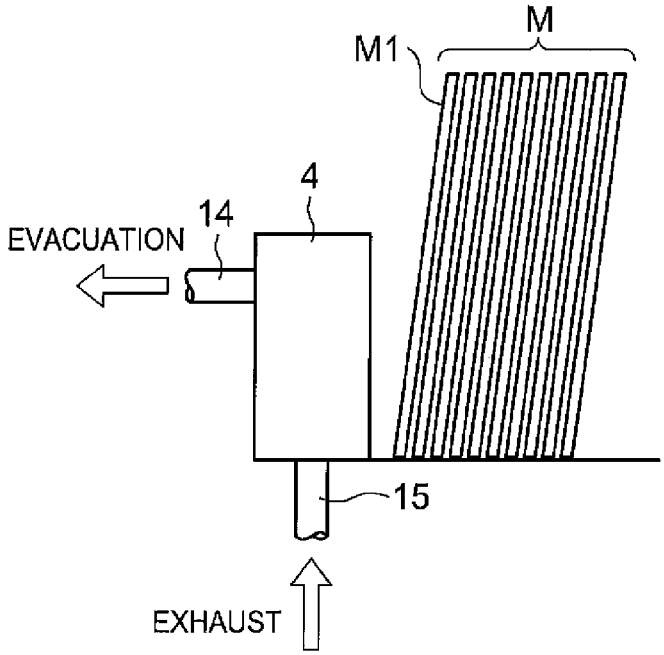
FIG. 8 is a diagram explaining an inclining state of mail articles with respect to the negative pressure chamber of FIG. 7.

Further, in the embodiment, an air flow in the negative pressure chamber 4 is controlled to take out the mail articles M at high speed. Specifically, attachment positions and attachment angles (directions) of the air suction tube 14 and the air supply tube 15 to the negative pressure chamber 4 are set as shown in FIG. 7 and FIG. 8 described above. The air supply tube 15 is attached to the air supply port 151 at a lower portion of the negative pressure chamber 4. The air supply tube 15 extends in a substantially gravity direction and is at a position where it is not directed toward the openings 4*a*, 4*b*. The air suction tube 14 is attached to the air suction port 141 disposed to an upper portion of a back surface in the negative pressure chamber 4 opposite to the takeout belt 2 side.

By attaching the air suction tube 14 and the air supply tube 15 to such positions and in such directions, a negative pressure can be more instantly generated on the adsorption surface side of the takeout belt 2 when the mail articles M are to be adsorbed to the takeout belt 2. Further, when the adsorbed mail articles M are released, the pressure in the negative pressure chamber 4 can be more instantly returned to the atmospheric pressure.

Figure 11:
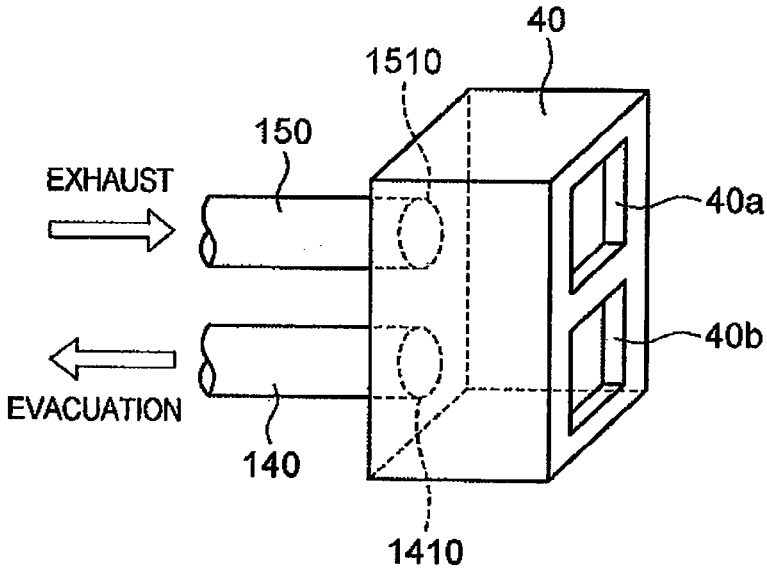
FIG. 11 PRIOR ART
FIG. 11 is a perspective view showing a connection of an air suction tube and an air supply tube to a negative pressure chamber in a comparative example.

For example, in a comparative example shown in FIG. 11, an air supply port 1510 of an air supply tube 150, which supplies air into a negative pressure chamber 40, is directed toward an opening 40*a* or 40*b* of the negative pressure chamber 40. The air supplied from a pump into the negative pressure chamber 40 can be directly discharged via the opening 40*a*. In this case, air for making the pressure in the negative pressure chamber 40 closer to the atmospheric pressure may leak. Accordingly, since the time necessary to return the pressure in the negative pressure chamber 40 to the atmospheric pressure is increased by an amount corresponding to the amount of air leaking through the opening 40*a*, much time may be required until a negative pressure is eliminated.

The mail article Ml, which is supplied to the takeout position S by the supply mechanism 3 of FIG. 1, is usually supplied in an inclined state as shown in FIG. 8. The mail articles M are conveyed by the floor belts 3*a*, 3*b* with the lower ends of the mail articles M directed toward the takeout position S. The mail articles arranged at the other end in an accumulation direction of the mail articles M are pushed by the backup plate 3*c*. Accordingly, the lower end sides of the mail articles M are first moved to the takeout position S.

Therefore, as shown in FIG. 11, for example, when the air suction tube 140 is attached to a position closer to a lower portion of the negative pressure chamber 40, air can be effectively sucked through the opening 40*b* of the lower portion but cannot be effectively sucked through the upper opening 40*a*. Therefore, This is disadvantageous to make the inclined mail M1 stand upright again and to adsorb the mail M1 to the takeout belt 2.

On the contrary, since the embodiment is configured as shown in FIG. 7, the air supplied into the negative pressure chamber 4 via the air supply tube 15 is not directly discharged through the openings 4*a*, 4*b*. Accordingly, the pressure in the negative pressure chamber 4 can be effectively and instantly returned to the atmospheric pressure without wastefully discharging air to return the pressure in the negative pressure chamber 4 to the atmospheric pressure.

More specifically, in order to achieve the above-described effect, assuming that the air supplied into the negative pressure chamber 4 via the air supply tube 15 flows while keeping the sectional shape of the air without dispersion, it is sufficient to connect the air supply tube 15 to the negative pressure chamber 4 so that a virtual straight flow path, from which the air does not disperse, can be located at a position and an angle at which the flow path does not intersect the openings 4*a*, 4*b*.

In other words, it is sufficient to connect the air supply tube 15 to the negative pressure chamber 4 at a position and an angle at which a virtual cylindrical body or an extending portion obtained by straightly extending an inner wall of the air supply tube 15 into the negative pressure chamber 4 does not intersect the openings 4*a*, 4*b*.

In particular, in order to return the pressure of the negative pressure chamber 4 being in a reduced pressure state to the atmospheric pressure in a short time, it is effective to satisfy the connecting condition of the air supply tube 15 described above as well as to supply air toward a center of the negative pressure chamber 4.

Thus, in the embodiment, the air supply tube 15 is attached to the negative pressure chamber 4 at a position and in a direction where an extended line of a center of the air supply tube 15 passes through the center of the negative pressure chamber 4. The negative pressure chamber 4 can be effectively pressurized by supplying the air to the center of the negative pressure chamber 4 and dispersing air outward from the center of the negative pressure chamber 4. As a result, the pressure in the negative pressure chamber 4 can be returned to the atmospheric pressure in a short time.

In the embodiment, the air suction tube 14 is connected to the negative pressure chamber 4 so that the air suction port 141, through which the air in the negative pressure chamber 4 is sucked via the air suction tube 14, is located at a position and an angle (direction) at which the air suction port 141 faces the upper opening 4*a* of the negative pressure chamber 4.

By connecting the air suction tube 14 in this manner, the air in the vicinity of the opening 4*a* can be preferentially sucked, a sufficient negative pressure can be generated on the adsorption surface side of the takeout belt 2 before the pressure in the negative pressure chamber 4 is sufficiently reduced, and the mail article M1 can be adsorbed onto the takeout belt 2 at an earlier timing.

More specifically, in order to achieve the effect, assuming that the air sucked via the air suction tube 14 flows along a virtual flow path to which an inside section of the air suction tube 14 is projected, it is sufficient to connect the air suction tube 14 to the negative pressure chamber 4 so that the virtual straight flow path can be located at a position and an angle at which the virtual straight flow path intersects the opening 4*a* or the opening 4*b*.

In other words, it is sufficient to connect the air suction tube 14 to the negative pressure chamber 4 so that a virtual cylindrical body, which is obtained by straightly extending the inner wall of the air suction tube 14 into the negative pressure chamber 4, can be located at a position and an angle at which the virtual cylindrical body intersects the openings 4*a*, 4*b*.

In the embodiment, the air suction tube 14 is connected to the back surface of the negative pressure chamber 4 in a direction substantially perpendicular to the back surface so that the virtual cylindrical body (the virtual flow path) can pass through the center of the upper opening 4*a* of the negative pressure chamber 4, as shown in FIG. 7. By connecting the air suction tube 14 in this manner, a negative pressure can be instantly generated on the adsorption surface side of takeout belt 2 via the opening 4*a*. Accordingly, in FIG. 1, the mail article M1 at the takeout position S can be adsorbed to the takeout belt 2 at an earlier timing.

In the embodiment, since the air suction tube 14 is connected so as to face the upper opening 4*a* of the negative pressure chamber 4 as shown in FIG. 7, the mail article M1 being in an inclined state and at the takeout position as shown in FIG. 8 can be well stood upright. Accordingly, an upper portion of the mail article M1 can be securely adsorbed to the takeout belt 2.

As described above, according to the takeout device 1 of the embodiment, adsorption and release of the mail articles M can be performed at a higher speed, and a plurality of mail articles M can be continuously taken out at a high speed.

Figure 9:
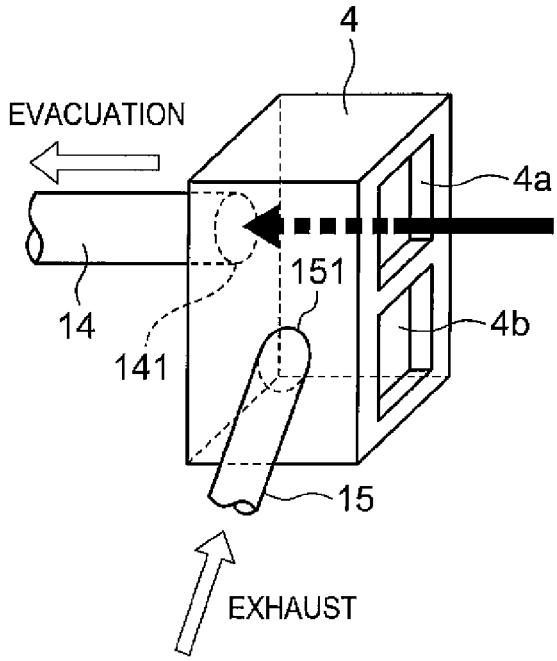
FIG. 9 is a perspective view for explaining a structure of a second embodiment.

A second embodiment will be described below. FIG. 9 shows a connection of an air suction tube and an air supply tube with a negative pressure chamber incorporated in a takeout device 1 according to the second embodiment.

As shown in FIG. 9, the air supply tube 15 is connected to a side surface of the negative pressure chamber 4 in an inclined attitude from obliquely downward. An air supply port 151 faces a center of the negative pressure chamber 4 likewise the first embodiment described above. The straight virtual flow path described above, along which air is supplied into the negative pressure chamber 4 via the air supply port 151, does not intersect openings 4*a*, 4*b*.

Accordingly, when adsorbed mail articles M are to be released, a pressure in the negative pressure chamber 4 can be instantly returned to the atmospheric pressure, and thus the mail articles M can be continuously taken out at a high speed also in the embodiment. In the embodiment, structures other than the connection of the air suction tube and the air supply tube with the negative pressure chamber are the same as those of the first embodiment.

Figure 10:
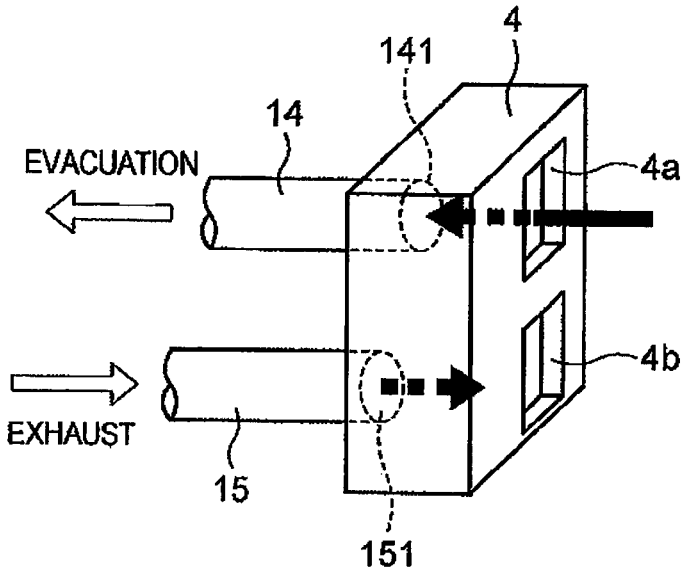
FIG. 10 is a perspective view for explaining a structure of a third embodiment.

A third embodiment will be described below. FIG. 10 shows a connection of an air suction tube and an air supply tube to a negative pressure chamber incorporated in a takeout device according to the third embodiment.

As shown in FIG. 10, the air supply tube 15 is connected to a back surface of the negative pressure chamber 4 in an attitude substantially perpendicular to the back surface at a position shifted from a center of the negative pressure chamber 4. The air supply port 151 does not face openings 4*a*, 4*b* of the negative pressure chamber 4.

Accordingly, the above straight virtual flow path of the air, which is supplied into the negative pressure chamber 4 via the air supply port 151, intersects the front surface of the negative pressure chamber 4 facing the takeout position S. In order to release the adsorbed mail articles M, a pressure in the negative pressure chamber 4 can be instantly returned to the atmospheric pressure, and thus the mail articles M can be continuously taken out at a high speed in the embodiment.

Although the negative pressure chamber 4 is rectangular parallelepiped in the embodiments, the negative pressure chamber 4 may be formed in other shape. For example, if the negative pressure chamber 4 is formed in a spherical shape, the air supply port 151 of the air supply tube 15 does not necessarily need to face the center. In this case, it is sufficient to configure the air supply port 151 of the air supply tube 15 so that at least the air supply port 151 does not face the openings 4*a*, 4*b*.

In the embodiments described above, the pump 16 is used as a suction unit to evacuate the negative pressure chamber 4. However, the suction unit is not limited to the pump. Instead, equipment such as a blower may be used as the suction unit.

In the embodiments, the air suction tube 14 and the air supply tube 15 are connected to the air suction port 141 and the air supply port 151, respectively, which are formed in the wall surface of the negative pressure chamber 4. The air suction tube 14 and the air supply tube 15 may be extended so that ends of the air suction tube 14 and the air supply tube 15 are located inside of the negative pressure chamber 4. In this case, the air suction tube 14 or the air supply tube 15 may be bent in the negative pressure chamber 4 so that the air suction port 141 and the air supply port 151 are directed in a desired direction.

Further, in the embodiments, the two openings 4*a*, 4*b* of the negative pressure chamber 4 are arranged in an up and down direction, i.e., vertically. However, the number of the openings of the negative pressure chamber is not limited to two. Three or more openings may be provided. The openings may be closed by mesh-like members.

According to the embodiments and the modifications described above, a plurality of paper sheets can be continuously taken out at a high speed.

While certain embodiments have been described, these embodiments have been presented by way of example only, and are not intended to limit the scope of the inventions. Indeed, the novel devices described herein may be embodied in a variety of other forms; furthermore, various omissions, substitutions and changes in the form of the devices described herein may be made without departing from the spirit of the inventions. The accompanying claims and their equivalents are intended to cover such forms or modifications as would fall within the scope and spirit of the inventions.

What is claimed is:

1. A paper sheet takeout device comprising:

a supply mechanism to move a plurality of accumulated paper sheets in an accumulation direction to supply the accumulated paper sheets to a takeout position sequentially from one of the paper sheets positioned at an end of the accumulation direction;

a takeout belt having a plurality of adsorption holes, the takeout belt running along a surface of a paper sheet to the takeout position;

a negative pressure chamber having an opening, the opening being arranged so as to directly face a surface of the takeout belt opposing an adsorption surface of the takeout belt facing the takeout position, which is opposite to a surface of a paper sheet supplied to the takeout belt;

a suction unit to suck air existing at the takeout position via the opening and the adsorption holes by evacuating the negative pressure chamber, and to adsorb each of the paper sheets sequentially supplied to the takeout position onto the adsorption surface of the takeout belt by causing a negative pressure to act on each of the paper sheets; and an air supply tube connected to the negative pressure chamber and the suction unit, wherein the negative pressure chamber has an air supply port to supply air into the negative pressure chamber through the air supply tube and to return the negative pressure to atmospheric pressure, the air supply port being arranged so that the air supplied via the air supply port is directed to a position and in a direction different from those of the opening of the negative pressure chamber, and the air supply tube is disposed so that a virtually extended portion of an inner wall of the air supply tube is arranged at a position and in a direction where the virtually extended portion does not substantially intersect the opening of the negative pressure chamber, and so that an extended line of a center of the air supply tube is arranged at a position and in a direction where the extended line passes through substantially a center point of the negative pressure chamber.

2. The paper sheet takeout device according to claim 1, wherein the adsorption holes of the takeout belt are formed with a space arranged between one another along a surface showing the takeout position.

3. The paper sheet takeout device according to claim 1, further comprising a suction chamber provided outside the takeout belt to suck air to absorb each of the paper sheets to the takeout position.

4. The paper sheet takeout device according to claim 1, wherein the adsorption holes of the takeout belt are formed with a space arranged between one another along a surface of a paper sheet supplied to the takeout position.

5. The paper sheet takeout device according to claim 4, further comprising a suction chamber provided outside the takeout belt to suck air to absorb each of the paper sheets to the takeout position.

6. The paper sheet takeout device according to claim 1, wherein the negative pressure chamber has an air suction port formed at a position facing the opening of the negative pressure chamber to suck air from the negative pressure chamber.

7. The paper sheet takeout device according to claim 6, further comprising an air suction tube connected between the air suction port and the suction unit, wherein the air suction tube is disposed so that a virtually extended portion of an inner wall of the air suction tube is arranged at a position and in a direction where the extended portion intersects the opening.

8. The paper sheet takeout device according to claim 6, wherein the air suction port is formed so as to face the opening at a position nearer to an upper portion of the negative pressure chamber.

9. The paper sheet takeout device according to claim 6, wherein the negative pressure chamber is further provided with another opening, and the air suction port is formed at a position facing one of the openings.

10. The paper sheet takeout device according to claim 6, wherein the adsorption holes of the takeout belt are formed with a space arranged between one another along a surface of a paper sheet supplied to the takeout position.

* * * * *